US010820680B1

(12) United States Patent
Macri

(10) Patent No.: US 10,820,680 B1
(45) Date of Patent: Nov. 3, 2020

(54) STENCIL ASSEMBLY AND METHOD OF APPLYING A COSMETIC OR OTHER PRODUCT USING A STENCIL ASSEMBLY

(71) Applicant: Lacey Macri, Roseville, CA (US)

(72) Inventor: Lacey Macri, Roseville, CA (US)

( * ) Notice: Subject to any disclaimer, the term of this patent is extended or adjusted under 35 U.S.C. 154(b) by 0 days.

(21) Appl. No.: 15/366,812

(22) Filed: Dec. 1, 2016

Related U.S. Application Data

(60) Provisional application No. 62/262,204, filed on Dec. 2, 2015.

(51) Int. Cl.
*A45D 40/30* (2006.01)
*B44D 2/00* (2006.01)

(52) U.S. Cl.
CPC ..... *A45D 40/30* (2013.01); *B44D 2/007* (2013.01)

(58) Field of Classification Search
CPC ..... A45D 24/32; A45D 24/36; A45D 40/30; A45D 44/003; A45D 44/12; A45D 44/002; A45D 19/0016; A45D 19/0025; A45D 27/42; A45D 2200/1036; A45D 2200/1027; A45D 2200/1018; A45D 2200/1009; B41N 1/24
USPC ..... 132/319, 213, 213.1, 214; 101/127, 101/127.1
See application file for complete search history.

(56) References Cited

U.S. PATENT DOCUMENTS 2,435,516 A 12/1945 Samson
2,917,058 A 12/1957 Ferrar
3,432,376 A * 3/1969 Lythgoe ..... B41M 5/10 156/234
3,485,251 A 12/1969 Brunet
4,884,719 A * 12/1989 Levine ..... A45D 33/00 221/25
5,150,726 A * 9/1992 Rucker ..... A45D 29/004 132/285
5,178,170 A 1/1993 Kassai
5,186,190 A 2/1993 Hirzel
5,647,941 A * 7/1997 Gunderman ..... A45D 40/0087 101/129
5,816,269 A * 10/1998 Mohammed ..... A45D 44/00 132/285

(Continued)

FOREIGN PATENT DOCUMENTS

WO WO2014122640 8/2014
WO WO2015080540 6/2015

*Primary Examiner* — Cris L. Rodriguez
*Assistant Examiner* — Brianne E Kalach
(74) *Attorney, Agent, or Firm* — Hanrahan Law Firm P.A.; Benjamin M. Hanrahan

(57) ABSTRACT

A cosmetic or other stencil assembly and a method of applying a cosmetic or other product using a stencil assembly are provided herein. The stencil assembly of at least one embodiment includes a stencil layer defining one or more inner, stencil portions or application zones, and one or more outer excess portions. The stencil layer is at least initially and at least partially attached to a transfer layer. Makeup, cosmetic or another product is applied to the stencil portion (s) or application zone(s) of the stencil layer, and subsequently, the excess portion(s) are removed from the transfer layer independently from the stencil portion(s). The transfer layer and the stencil portion(s) with makeup applied thereto may then be applied to the skin, thereby transferring the makeup to the skin in the shape of the stencil portion(s).

19 Claims, 8 Drawing Sheets

(56) References Cited

U.S. PATENT DOCUMENTS

| | | | | |
|---|---|---|---|---|
| 6,035,867 | A * | 3/2000 | Barrick | A45D 40/0087 132/319 |
| 6,074,721 | A * | 6/2000 | Moore | B41M 3/12 156/89.11 |
| 6,264,786 | B1 * | 7/2001 | Cromett | B44C 1/1733 156/230 |
| 6,305,389 | B1 | 10/2001 | Bakken | |
| 8,051,860 | B1 | 11/2011 | Pereira | |
| 10,702,042 | B2 * | 7/2020 | Shimley | A45D 40/30 |
| 2004/0107975 | A1 | 6/2004 | Bender | |
| 2005/0214495 | A1 * | 9/2005 | Thiebaut | A45D 37/00 428/40.1 |
| 2006/0150994 | A1 * | 7/2006 | Pilmanis | A45D 40/30 132/218 |
| 2006/0249173 | A1 | 11/2006 | Lawson | |
| 2011/0073125 | A1 | 3/2011 | Iosilevich | |
| 2014/0158147 | A1 | 6/2014 | Butcher | |
| 2016/0286935 | A1 * | 10/2016 | Macias-Abu | A45D 40/30 |

* cited by examiner

STENCIL ASSEMBLY AND METHOD OF APPLYING A COSMETIC OR OTHER PRODUCT USING A STENCIL ASSEMBLY

CLAIM OF PRIORITY/CROSS REFERENCE TO RELATED APPLICATION

The present application is based on and a claim to priority is made under 35 U.S.C. § 119(e) to currently provisional patent application Ser. No. 62/262,204, having a filing date of Dec. 2, 2015, the contents of which are incorporated herein in their entirety by reference.

FIELD OF THE INVENTION

The present invention is generally directed to cosmetic applications, in particular a cosmetic stencil or assembly and a method for applying a cosmetic to a user's skin via the cosmetic stencil or assembly. Other embodiments of the present invention may be used to apply tattoos, temporary tattoos, temporary or permanent makeup, costume makeup, etc. to the surface of a user's or individual's skin.

BACKGROUND OF THE INVENTION

Freehand application of makeup and cosmetics, for example, but not limited to, eye liner, is oftentimes laborious, time consuming, and in cases where a unique and attractive design such as a 'cat eye' design is desired, difficult to obtain an attractive, precise and/or accurate design or shape. Accordingly, the proposed invention is designed to provide an application of makeup, cosmetic, ink, tattoo, temporary or permanent tattoo, etc., using a peel-and-stick cosmetic stencil assembly.

In some implementations, a stencil defining an inner opening may be adhered, applied or held to the skin, such that a user may apply makeup or cosmetic directly to the skin through one or more openings defined by the stencil. Other embodiments may allow a user to first apply the cosmetic to the stencil or assembly and then transfer the cosmetic to the user's skin.

Furthermore, the shape of the stencil and/or transfer layer may be designed to specifically fit the shape of an eye or other portion of the body so as to prevent or minimize the creation of folds, creases or bubbles. Different shapes and sizes may be made available for different applications or preferences by the users.

SUMMARY OF THE INVENTION

The present invention is generally directed to a peel-and-stick cosmetic or other stencil assembly for facilitating the application of a cosmetic or makeup to a user's skin, for example, but not limited to, at or near the user's eyes or face. The cosmetic or other stencil assembly of at least one embodiment of the present invention includes a stencil layer with an inner stencil portion, application zone or opening that defines a stencil shape or makeup application area. At least one surface of the stencil layer may include an adhesive which can be initially covered, for example, by virtue of a waxed or other backing layer or paper.

In some embodiments, the stencil layer may be applied directly to the user's face or skin (e.g., at or near an eye) by exposing the adhesive surface and/or temporarily adhering or placing the stencil layer to or on the skin, for example, in the location where the application of makeup is desired. In such an embodiment, the stencil layer includes an opening that exposes a portion of the skin there through, allowing the user to apply makeup or other cosmetic to the stencil and through the opening. Removal of the stencil from the skin will thus reveal a makeup or cosmetic application on the skin in the shape of the opening(s) formed or defined by the stencil.

In another embodiment, the cosmetic stencil may include a transfer layer initially interconnected or attached to the stencil layer—wherein the stencil layer comprises one or more stencil portions or application zones defining the stencil shape(s) and one or more outer or excess portions at least partially surrounding the stencil portion(s). The inner (stencil) and outer (excess) portions may be separable from one another, for example, wherein the stencil portion(s) and excess portion(s) are demarcated via one or more pre-cut or perforated lines. In this embodiment, the backing paper or backing layer (if present) may be removed from the stencil layer thereby exposing the stencil portion (application zone) and the excess portion of the stencil layer.

The user may then apply a product (e.g., makeup or other cosmetic, ink, temporary tattoo, henna, etc.) to the stencil portion or application zone of the stencil layer—some make-up, cosmetic or product may cross over onto the outer or excess portion of the stencil layer, as well. Once a desired amount of makeup is applied to the inner stencil portion(s) or application zone(s) of the stencil layer, the outer or excess portion(s) of the stencil layer may be removed from the transfer layer, thereby leaving the stencil portion or application zone of the stencil layer attached or adhered to the transfer layer.

Using the transfer layer, the stencil portion or application zone of the stencil layer is then applied to the user's skin, for example, at or near an eye, with the cosmetic facing the skin. Pressing on the back of the transfer layer will transfer at least a portion of the cosmetic or other product from the stencil portion or application zone of the stencil layer to the skin in the same shape as the stencil portion or application zone of the stencil layer. The user can then carefully remove the transfer layer and the stencil portion of the stencil layer from the skin thereby leaving an application of makeup, cosmetic or other product to the skin in the shape of the stencil portion or application zone of the stencil layer.

In yet another embodiment, the stencil layer may include at least one opening or hole defining a desirable stencil shape. In this embodiment, the backing paper or backing layer (if present) may be removed from the adhesive or other surface of the stencil thereby exposing the stencil layer and the opening defined thereby. At least a portion of the interconnected transfer layer may be exposed through the opening of the stencil layer. In some embodiments, the transfer layer includes an adhesive surface facing the stencil layer, such that the stencil layer and the transfer layer are adhered to one another, and the adhesive surface of the transfer layer is exposed through the opening of the stencil layer.

With a portion of the transfer layer exposed through the opening of the stencil layer, the user may apply makeup, cosmetic or other product to the stencil layer and/or through the opening or application zone of the stencil layer and onto the transfer layer. Once a desired amount of makeup is applied, the transfer layer and the stencil layer may be separated from one another, such that the transfer layer will include an amount of makeup, cosmetic or other product applied thereto in the shape and location of the opening or application zone from the stencil layer.

The transfer layer is then applied to the user's skin, for example, at or near an eye, with the cosmetic and adhesive surface facing the skin. Pressing on the transfer layer will transfer at least a portion of the cosmetic or other product to the skin in the same shape, such that carefully removing the transfer layer from the skin will result in an application of makeup, cosmetic or other product to the skin in the shape of the opening defined by the stencil layer.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1A:
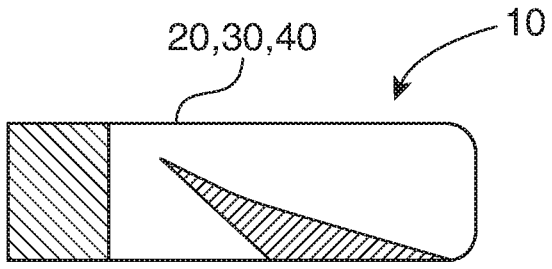
FIG. 1A is a top view of the stencil assembly of at least one embodiment of the present invention, with a transfer layer, stencil layer and backing later connected with or stacked upon one another.
Figure 1B:
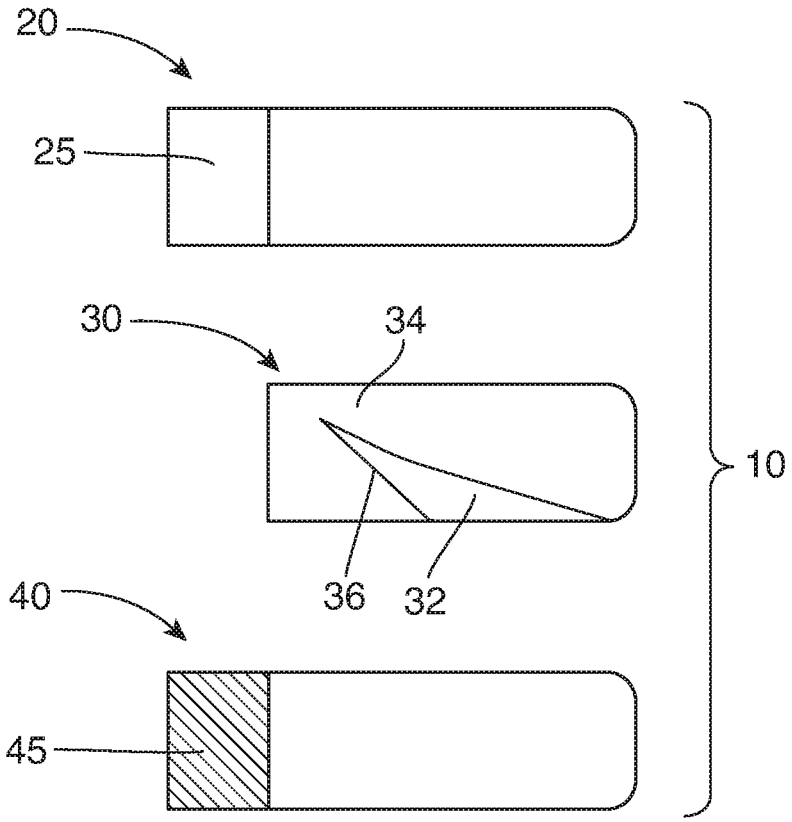
FIG. 1B is an exploded view of the various layers of the stencil assembly as disclosed in accordance with at least one embodiment of the present invention.
Figure 2:
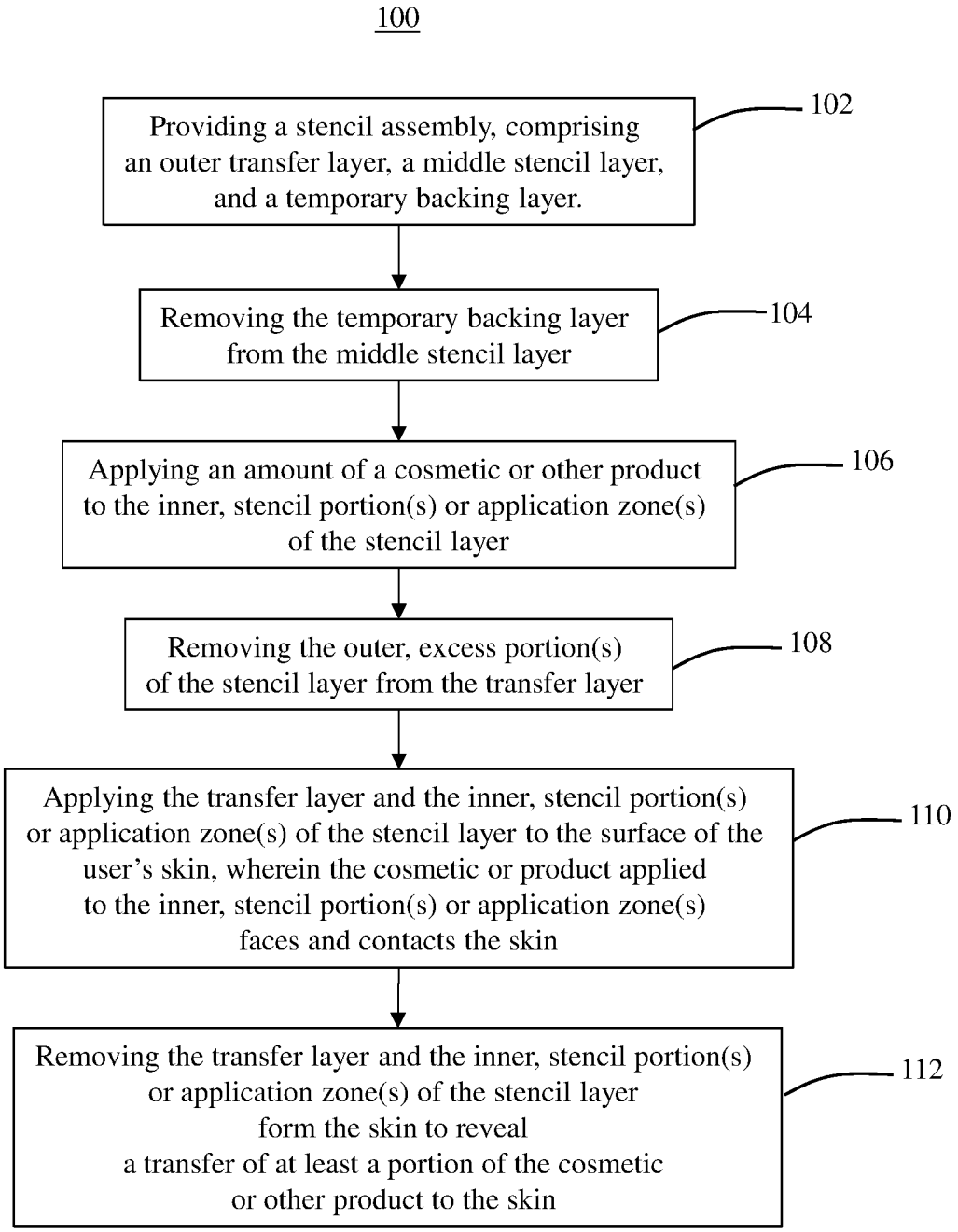
FIG. 2 is a high level flow chart illustrating the method for applying a cosmetic or other product using the stencil assembly as disclosed in accordance with at least one embodiment of the present invention.
Figure 3:
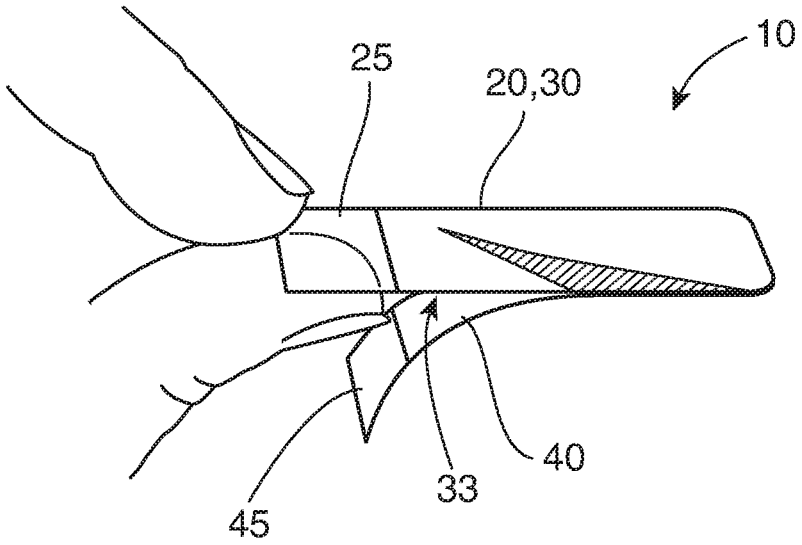
FIG. 3 is a side view of the stencil assembly as disclosed in at least one embodiment of the present invention, with a user peeling away the backing layer thereof.

As shown in the accompanying drawings, and with particular reference to FIGS. 1A, 1B and 3, for example, the present invention is directed to a cosmetic or other stencil assembly, generally referenced as 10. As will be described herein, and as generally illustrated in FIG. 2, other embodiments of the present invention are directed to a method 100 for applying a cosmetic or other product (including, but not limited to henna, temporary tattoos, etc.) to a surface of user's skin.

Specifically, the stencil assembly 10 of at least one embodiment is constructed of a plurality of layers and is configured to assist in the application of cosmetics or other products to the surface a user's skin, including, for example, at or around the eye, although other locations of the skin or body are contemplated and included in the scope of the various embodiments of the present invention. Accordingly, the product, as used herein, may include, for example, a cosmetic, makeup or any material, solution, lotion, powder, gel, ink, lipstick, rouge, pencil, primer, etc. that can be applied to the surface of a user's skin. For example, the product may be used in a manner to beautify the user's skin, including the user's face, nails, etc., although it should be noted that the present invention may be used in virtually any makeup or cosmetic application, including for theatrical makeup, costume makeup, etc. Other embodiments may be used to apply other products, such as henna or temporary tattoo products to the surface of a user's skin.

In particular, at least one embodiment of the stencil assembly 10 of the present invention includes an outer transfer layer 20 and a stencil layer 30. As shown in FIG. 1B, at least some embodiments also include a temporary backing layer 40. For example, the layers, 20, 30, 40 are, at least initially, stacked upon, connected or attached to one another in the manner or order shown in FIG. 1B, such that the stencil layer 30 of at least one embodiment is disposed between the outer transfer layer 20 and the backing layer 40.

For instance, the transfer layer 20 and the stencil layer 30 may be at least initially and at least partially adhered or connected to one another, for example, at least until the user is prepared to at least partially separate the transfer layer 20 and stencil layer 30 in order to transfer the makeup or other cosmetic or product to the skin, as described herein. In this manner, the transfer layer 20 may include an adhesive surface facing the stencil layer 30, or the stencil layer 30 may include an adhesive surface facing the transfer later 20. Other ways in which the transfer layer 20 and the stencil layer 30 can be at least initially and at least partially connected to one another is contemplated within the full spirit and scope of the present invention.

Furthermore, the transfer layer 20 of at least one embodiment of the present invention may be constructed of a soft, pliable material that can accommodate the natural contours of the user's skin, and in particular, the face, and in order to reduce or restrict the development of air bubbles, bends, or crease marks from forming in the transfer layer 20 during application of the present invention. Moreover, the transfer layer 20, while flexible, may be at least partially rigid in order to facilitate an easy application, for example, by allowing the user to easily grab onto the material and manipulate it in accordance with the various embodiments of the present invention. As such, the transfer layer 20 of at least one embodiment may be constructed of a soft, pliable, yet somewhat rigid vinyl or polyester, although other materials structured to facilitate practice of the present invention in the intended manner are contemplated.

Still referring to FIGS. 1A and 1B, and as mentioned above, the stencil assembly 10 of at least one embodiment further includes a stencil layer 30 disposed in an at least initially interconnected, connected, adhered, attached or stacked relation with the transfer layer 20. The stencil layer 30 of at least one embodiment includes or is otherwise defined by one or more inner stencil portions or application zones 32 and one or more outer or excess portions 34. The inner, stencil portion(s) or application zone(s) 32 define a shape or stencil, such as a makeup, cosmetic or other product application area, which will transfer the product to the user's skin, as described herein. Particularly, in certain embodiments, the stencil portion(s) or application zone(s) 32 and the excess portion(s) 34 of the stencil layer 30 may be separable from one another such that when or if the excess portion(s) 34 of the stencil layer 30 is removed from the attached transfer layer 20, the stencil portion(s) or application zone(s) 32 may remain. In this manner, the stencil portion or application zone 32 and the excess portion 34 of the stencil layer 30 may be separated or demarcated by one or more pre-cut lines 36 in order to facilitate the independent or separate removal of the excess portion 34 from the application zone 32 and/or the transfer layer 20. Other embodiments may include partial cut demarcations, one or more perforated lines, etc. between the stencil portion or application zone 32 and the surrounding excess portion 34 of the stencil layer 30 to facilitate the separate and independent removal of the excess portion 34 of the stencil layer 30 from the stencil portion or application zone 32 and/or the transfer layer 20.

In particular, as described in more detail herein in accordance with at least one embodiment, with the stencil portion or application zone 32 and excess portion 34 of the stencil layer attached to the transfer layer 20, the makeup, cosmetic or other product may be applied to the inner or stencil portion 32 of the stencil layer 30, and therefore within the makeup application area or zone thereof. During the application, the makeup, cosmetic or other product can cross over onto the outer or excess portion 34 of the stencil layer.

Furthermore, it should be noted that the stencil layer 30 of at least one embodiment may include an adhesive surface 33, for example, facing the temporary backing layer 30. In this regard, the adhesive surface 33 of the stencil layer 30 may facilitate the temporary interconnection between the stencil layer 30 and the backing layer 40. Either the application zone 32, the excess portion 34, or both may include an adhesive surface 33 facing the backing layer 40.

Furthermore, the stencil layer 30 of at least one embodiment of the present invention may be constructed of a soft, pliable material, although, in some cases, the stencil layer 30, while flexible, may be at least partially rigid, such as a soft, pliable, yet somewhat rigid vinyl or polyester, although other materials structured to facilitate practice of the present invention in the intended manner are contemplated.

Moreover, the backing layer 40 of certain embodiments may include a waxed backing paper temporarily interconnected to the stencil layer 30 in order to provide protection or covering prior to use. For instance, the backing paper or backing layer 40 may include a waxed surface that faces the adhesive surface 33 of the adjacent stencil layer 30. When the user is ready to use the stencil assembly 10, the backing layer 40 may be removed, thereby exposing the stencil layer 30.

It should be noted that other embodiments may include virtually any backing layer 40 structured to facilitate the temporary protection or covering of the stencil layer 30 and/or transfer layer 20, for example, during shipping, packaging, or otherwise, prior to use of the stencil assembly of the present invention. Still, some embodiments may not have a backing layer 40.

Turning now to FIGS. 2 through 8, the method 100 for applying a cosmetic or other product to a user's skin using the stencil assembly 10 of the present invention is described and shown. For example, the method 100 includes providing a cosmetic or other stencil assembly, as shown at 102, which may include a transfer layer 30, stencil layer 30, and in some embodiments, a backing layer 40, as provided herein.

As shown at 104 in FIG. 2, and as illustrated in FIG. 3, the method 100 further includes removing the backing layer 40 from the middle stencil layer 30 in order to expose at least a portion of the stencil layer 30 (which, at this point, remains attached to the transfer layer 20). Specifically, the backing layer 40 may be peeled off or removed from the stencil layer 30, leaving the transfer layer 20 and the stencil layer 30 interconnected or stacked upon one another.

Furthermore, as illustrated the backing layer 40 may include a tab 45 which may be adapted or configured to easily grab and facilitate the peeling or removal of the backing layer 40. For instance, in at least one embodiment, and as shown in the exploded view of FIG. 1B, the baking layer 40 may include a length greater than a length of the stencil layer 30. In this manner, at least a portion of the backing layer 40 that extends beyond the stencil layer 30 may be defined as the tab 45 which can be easily grabbed or grasped, for instance, with an index finger and thumb. In order to further facilitate the grabbing or the tab 45, the tab 45 in some embodiments may be free or otherwise not adhered or connected to any portion of the stencil layer 30 or transfer layer 20.

In particular, still referring to the exploded view of FIG. 1B, the transfer layer 20 of at least one embodiment may also include a length greater than the length of the stencil layer 30, and specifically, the transfer layer 20 may include a length substantially or exactly equal to the length of the backing layer 40, such that both the backing layer 40 (and in particular, the tab 45 there) and a portion of the transfer layer 20 (e.g., extension portion 25) may extend beyond the outer peripheral end of the stencil layer 30. In this regard, portion 25 of the transfer layer 20 and tab 45 of the backing layer 40 may be aligned with one another. Since, in at least one embodiment, the tab 45 is not adhered or specifically connected to aligned portion 25 of the transfer layer 20, the tab 45 may be easily grabbed or grasped and the backing layer 40 may be easily removed from the stencil layer 30 (and the still connected transfer layer 20), as again shown in FIG. 3.

Figure 4A:
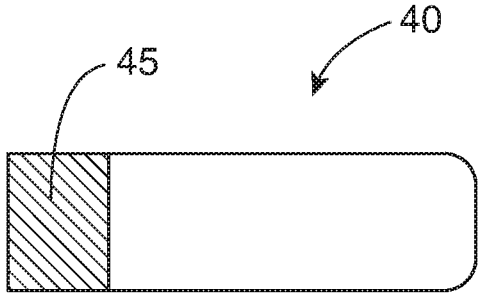
FIG. 4A is a top view of the backing layer removed from the stencil assembly of at least one embodiment of the present invention.
Figure 4B:
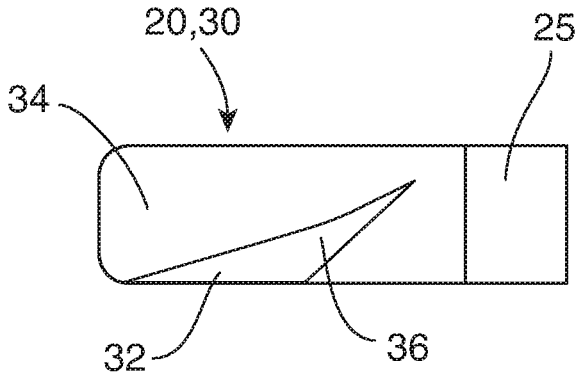
FIG. 4B is a bottom view of the combined transfer layer and stencil layer as disclosed in at least one embodiment of the present invention.

Particularly, FIG. 4A shows the separate backing layer 40 (which may be set aside or discarded) and FIG. 4B shows the bottom or underside of the combined stencil layer 30 and transfer layer 30.

Figure 4C:
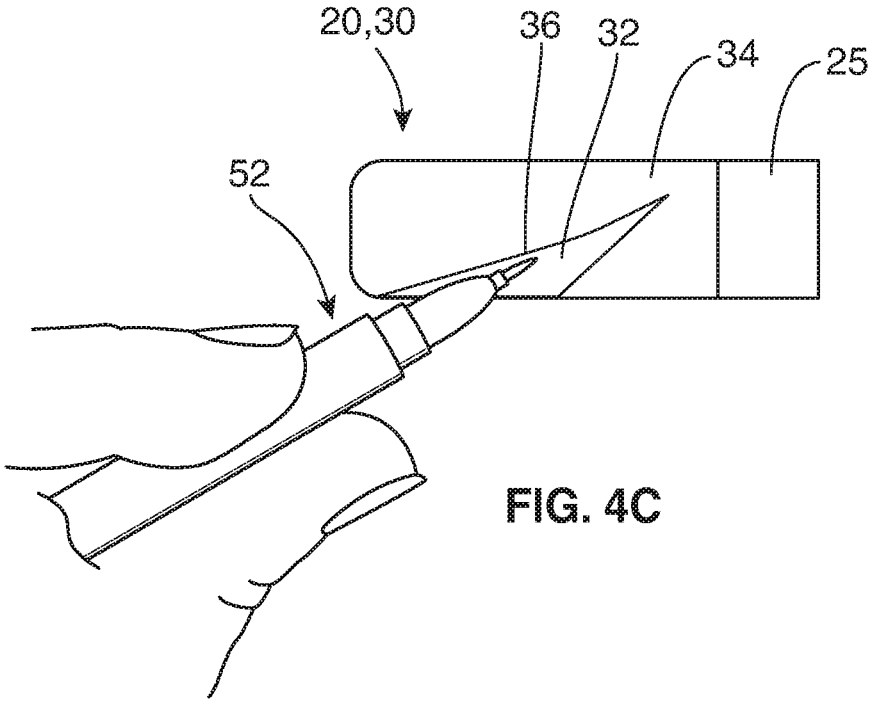
FIG. 4C is a bottom view of the combined stencil layer and transfer layer of at least one embodiment showing application of a cosmetic or other product onto the stencil portion or application zone of the stencil layer.
Figure 4D:
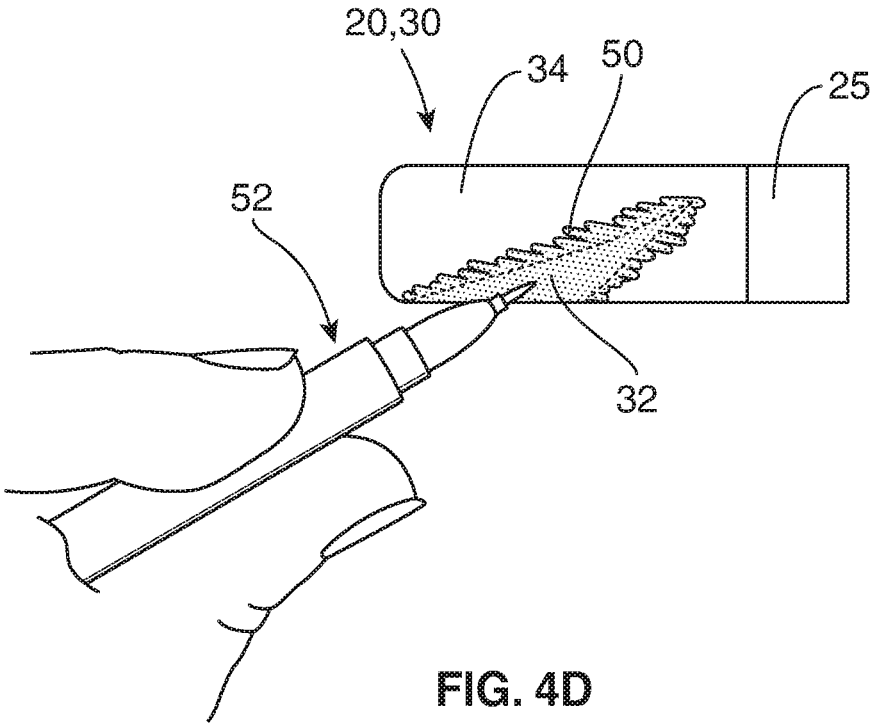
FIG. 4D is another bottom view of the combined stencil layer and transfer layer of at least one embodiment showing application of a cosmetic or other product onto the stencil portion or application zone of the stencil layer.
Figure 5:
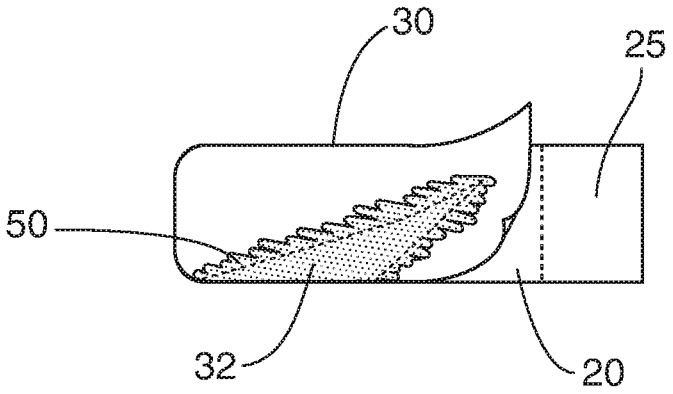
FIG. 5 is a bottom view of the transfer layer and the stencil layer of at least one embodiment of the present invention, showing the excess portion of the stencil layer being removed from the transfer layer.

Next, as shown at 106 in FIG. 2, and with reference to FIGS. 4C and 4D, the method 100 includes applying an amount of makeup, cosmetic or other product, generally referenced as 50, to the inner or stencil portion 32 of the stencil layer 30. For example, a liquid eye liner pen 52 may be used to color or fill in the stencil portion 32 of the stencil layer 30. Of course, other makeup, cosmetics or other products may be used in addition to or instead of liquid eye liner, including, for example, virtually any solution, lotion, powder, gel, ink, lipstick, rouge, pencil, primer, henna, etc. that can be applied to the surface of a user's skin. In any event, the makeup, cosmetic or other product 50 may be applied liberally, while keeping distribution within inner, stencil portion or application zone 32 as equal or even as possible. The inner, stencil portion or application zone 32 of the stencil layer 30 may be filled in completely with the makeup, cosmetic or other product 50, and coloring or filling outside of the demarcation line(s) 36 between the stencil portion 32 and the excess portion 34 of the stencil layer 30 is acceptable.

Figure 6:
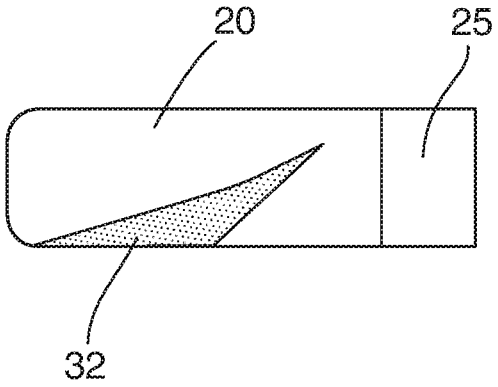
FIG. 6 is a bottom view of the transfer layer with the excess portion of the stencil layer removed, leaving the stencil portion or application zone of the stencil layer connected thereto, as disclosed in accordance with at least one embodiment of the present invention.

Referring now to reference character 108 in FIG. 3, the method 100 further includes removing the outer or excess portion(s) 34 of the stencil layer 30 from the transfer layer 20 in a manner such that only the inner, stencil portion(s) or application zone(s) 32 of the stencil layer 30 (and the applied makeup, cosmetic or other product 50) remains attached to the transfer layer 20. For instance, referring to FIGS. 5 and 6, the outer or excess portion 34 of the stencil layer 30 and the transfer layer 20 are carefully peeled or separated from one another. As shown in FIG. 6, the stencil portion or application zone 32 of the stencil layer 30 will remain attached to the transfer layer 20 and will include a filled in portion of cosmetic or other product 50 in the shape and contour of the stencil portion or application zone 32.

Figure 7A:
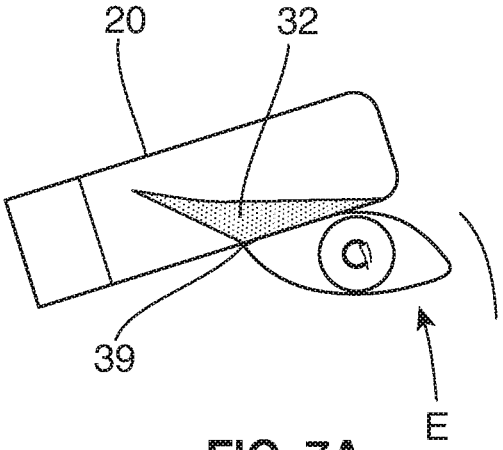
FIG. 7A is an exemplary illustration of the transfer layer and stencil portion or application zone of the stencil layer being applied to the surface of a user's skin.
Figure 7B:
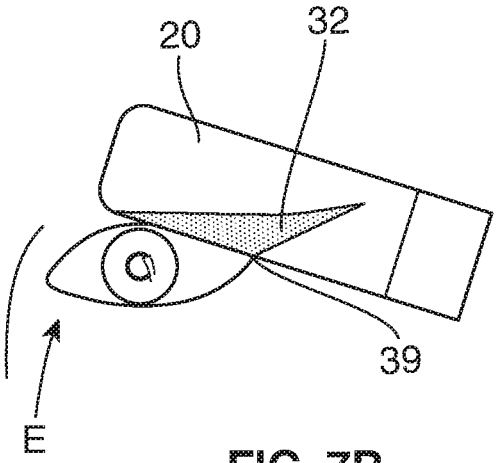
FIG. 7B is another exemplary illustration of the transfer layer and stencil portion or application zone of the stencil layer being applied to the surface of a user's skin.

With the outer or excess portion 34 of the stencil layer 30 separated or removed from the transfer layer 20, the method 100 continues by applying the transfer layer 20 and stencil portion or application zone 32 of the stencil layer 30 to the surface of the user's skin in a manner such that the cosmetic or other product faces and contacts the skin, as shown at 110 in FIG. 2, and as exemplified in FIGS. 7A and 7B. In some embodiments, the transfer layer 20 and/or the application zone 32 of the stencil layer 30 includes an adhesive surface, and thus, application of the transfer layer 20 and/or application zone 32 to the user's skin may include at least partially adhering the transfer layer 20 and/or the application zone 32 to the skin via the corresponding adhesive surface.

For instance, in the illustrated embodiment, eye makeup is used, and thus, the transfer layer 20 and stencil portion or application zone 32 of the stencil layer 32 is aligned with the eye E in the location where the user wants to apply the makeup. As shown, the bottom outer corner of the makeup portion or application zone 32 of the stencil layer 30, referenced as 39, may be aligned with a top edge or corner of the upper eyelid. Of course, other locations or alignments are included within the full spirit and scope of the present invention, and thus, the illustrated example in FIGS. 2 through 8 should not be deemed limiting in any manner.

Furthermore, in some embodiments, the transfer layer 20 may be at least partially transparent or translucent in that the user may be able to see the surface of the skin through the transfer layer 20 as the transfer layer 20 and inner or stencil portion 32 of the stencil layer 30 is applied or adhered to the surface of the user's skin. This can help facilitate proper alignment and placement of the transfer layer 20 and in particular the makeup applied thereto.

With the transfer layer 20 applied to the skin, the user may press against the transfer layer 20, for example, evenly and firmly with a fingertip in a sliding motion from one edge (e.g., an outer corner) to the other. This will facilitate an even transfer of the cosmetic or other product 50 from the inner or stencil portion or application zone 32 of the stencil layer 30 to the user's skin in the shape and contour as the stencil.

Figure 8:
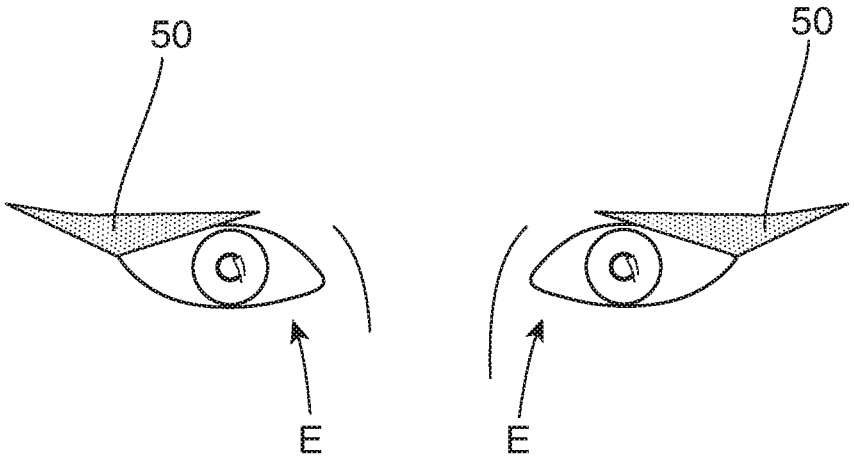
FIG. 8 is an exemplary illustration showing the cosmetic transferred to the surface of the user's skin.

With reference to 112 in FIG. 3, and as exemplified in FIG. 8, the user may then remove the transfer layer 20 and the stencil portion or application zone 32 of the stencil layer 30 from the skin in order to reveal a transfer of at least a portion of the cosmetic or product 50 from the transfer layer 20 to the skin in the shape of the stencil. For instance, the user may slowly peel the transfer layer 20 and stencil portion or application zone 32 of the stencil layer 30 away from the skin or eye E while holding the surrounding skin taut. Once the transfer layer 20 and stencil layer 32 are removed, the decorative cosmetic or other product 50 will remain on the user's skin, as shown in FIG. 8. Additional makeup applications can follow, for example, using mascara or other desired cosmetics.

It should be noted that in other embodiments, the application zone 32 of the stencil layer 30 may be defined as including one or more openings or holes through which the makeup is applied. For instance, the stencil layer 30 may be constructed or manufactured in this manner (i.e., with an opening or hole defining the application zone), or the inner stencil portion 32 may be removed by the user to create the opening or hole.

For example, the method may include providing a cosmetic or other stencil assembly, which may include a transfer layer, a stencil layer, and in some embodiments, a backing layer, as provided herein. The method may further include removing the backing layer from the stencil layer in order to reveal or expose the stencil layer. In some embodiments, removing the backing layer will expose at least a portion of the outer transfer layer through at least one opening or hole defined in the stencil layer. Specifically, the backing layer may be peeled off or removed from the stencil layer, leaving the transfer layer and the stencil layer interconnected or stacked upon one another. With the backing layer removed, the opening in the stencil layer will expose a portion of the transfer layer there through. In some embodiments, an inner stencil portion 32 may be removed (leaving the excess or outer portion 34 attached to the transfer layer 20) in order to reveal or create the opening.

Next, the method may further include applying an amount of makeup, cosmetic or other product 50 to the transfer layer 20 through the opening in the stencil layer. For example, a liquid eye liner pen may be used to color or fill in the opening through the adhesive side of the stencil layer and onto the adhesive side of the transfer layer. As before, the makeup, cosmetic or other product 50 may be applied liberally, while keeping distribution within the opening as equal or even as possible. The opening may be filled in completely with the makeup, cosmetic or other product 50, and coloring or filling outside of the lines defining the opening is acceptable.

Moreover, the method may further include removing the transfer layer from the stencil layer in order to expose a portion of the transfer layer filled in with the cosmetic 50 in the shape and contour of the opening of the stencil layer. For instance, the transfer layer and the stencil layer may be carefully peeled or separated from one another. Once the two layers are removed from one another, the transfer layer will include a filled in portion of cosmetic or other product 50 resembling the shape and contour of the opening of the stencil layer.

With the transfer layer separated and including the cosmetic 50 applied thereto, the method continues by applying the transfer layer to the surface of the user's skin in a manner such that the cosmetic faces and contacts the skin. In some embodiments, the transfer layer includes an adhesive surface upon which the cosmetic is applied. Accordingly, application of the transfer layer to the user's skin may include at least partially adhering the transfer layer to the skin via the adhesive surface.

With the transfer layer applied to the skin, the user may press against the transfer layer, for example, evenly and firmly with a fingertip in a sliding motion from one edge (e.g., an outer corner) to the other. This will facilitate an even transfer of the cosmetic or other product 50 from the transfer layer to the user's skin in the shape and contour as the stencil. The user may then remove the transfer layer from the skin in order to reveal a transfer of at least a portion of the cosmetic from the transfer layer to the skin in the shape of the stencil or opening thereof.

In yet another embodiment (not shown), for example, the stencil layer may be applied to the user's skin, and the cosmetic may be applied directly to the skin through the opening. Accordingly, in this embodiment, a transfer layer may not be included or used, rather, the stencil layer may be directly adhered or applied to the skin, exposing a portion of the skin through the opening or makeup application area or zone. As before, the stencil layer may be adhesive backed, meaning that the stencil layer may include an adhesive surface that can contact and adhere to the skin. In some embodiments, the adhesive may be moisture-resistant, for example, in order to keep the cosmetic, such as liquid based makeup, within the opening to reduce or prevent blurring or smearing of the makeup beyond the opening. The moisture-resistant adhesive may also be resistant to the natural moisture and oils from the air or the user's skin.

It should be noted that the shape of the stencil layer may vary and may be constructed to fit the shape of an eye or other portion of the user's face or skin so as to reduce or prevent folds, creases, and/or bubbles that may be associated with insufficient surface area. In some cases, the stencil layer may be reusable, for example, until the adhesive surface loses tackiness such that a tight seal on the user's face or skin cannot be sufficiently accomplished. As an example, the cosmetic stencil assembly may be reusable 3 or more times, after which they can be discarded, as the materials used to construct the various layers may be environmentally friendly.

Furthermore, various shapes, sizes and dimensions of the stencil layer and/or opening or application zone may be manufactured and in some cases included in a single package. In this manner, the user may be able to select which stencil layer to use or which one fits best. In addition, in some embodiments, at least one edge (e.g., a bottom edge) may be open such that the opening or application zone extends all the way to at least one edge of the stencil layer.

Moreover, in some embodiments, the stencil layer 30 and/or transfer layer 20 may include a reference point or reference notation that can be used for correct or ideal placement of the stencil layer 30 and/or transfer layer 20 on the user's face or skin. For example, in some embodiments, the reference point may be lined up with a particular location on the user's face (e.g., the corner of the eye) in order to properly align the stencil, opening or transfer layer.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A multi-layer stencil assembly, comprising:

a transfer layer comprising a first surface and a second surface, a flexible stencil layer comprising a top surface and a bottom surface, and a backing layer comprising a facing surface and an outer surface, said stencil layer being disposed, at least initially, between said transfer layer and said backing layer such that the bottom surface of the stencil layer is engaged with the first surface of the first surface of the stencil layer, said stencil layer comprised of an application portion defining a shape of cosmetic to be transferred to a user, the shape defined by a demarcation line, and an excess portion extending outward from the demarcation line such that it forms at least a partial outer perimeter of the stencil layer, wherein removal of said backing layer from the stencil layer is configured to expose said top surface of said stencil layer, which is devoid of and is configured to receive a cosmetic product, wherein after cosmetic product is applied to the exposed application portion, the excess portion of the stencil layer is configured to be removed from the stencil layer along the demarcation line and the exposed application portion is configured to be pressed to skin of the user in order to transfer the applied cosmetic product thereto, while said bottom surface of said application portion of said stencil layer and said first surface of said transfer layer and said application portion of said stencil layer remain connected to one another.

2. The assembly as recited in claim 1 wherein said transfer layer and said excess portion of said stencil layer are at least initially removably attached to one another.

3. The assembly as recited in claim 1 wherein said demarcation line comprises an at least partially precut section between said application portion and said excess portion.

4. The assembly as recited in claim 1 wherein said demarcation line comprises at least one perforated line between said application portion and said excess portion.

5. The assembly as recited in claim 1 wherein said demarcation line comprises a completely precut line between said application portion and said excess portion.

6. The assembly as recited in claim 1 wherein said excess portion is independently removable from said transfer layer relative to said application portion, wherein said application portion of said stencil layer is adapted to remain connected to said transfer layer when said excess portion is removed from said transfer layer.

7. The assembly as recited in claim 1 wherein said backing layer comprises a length greater than a length of said stencil layer.

8. The assembly as recited in claim 7 wherein said backing layer comprises a tab defined as a portion of said backing layer extending beyond said length of said stencil layer.

9. The assembly as recited in claim 8 wherein said transfer layer comprises a length substantially equal to said length of said backing layer.

10. The assembly as recited in claim 9 wherein said tab of said backing layer is not adhered attached to either said stencil layer or said transfer layer.

11. The assembly as recited in claim 10 wherein said transfer layer is at least partially transparent.

12. The assembly as recited in claim 1 wherein said application portion of said stencil layer comprises a wing-shaped configuration.

13. The assembly as recited in claim 12 wherein said wing-shaped configuration comprises a least two elongated edges converging at an apex.

14. A method of applying a product to a surface of a user's skin, the method comprising:

providing a cosmetic stencil assembly, the cosmetic stencil assembly comprising:

a transfer layer comprising a first surface and a second surface, a flexible stencil layer comprising a top surface and a bottom surface, the stencil layer further comprising an application portion defining a shape of cosmetic to be transferred to a user, the shape defined by a demarcation line, and an excess portion extending outward from the demarcation line such that it forms at least a partial outer perimeter of the stencil layer, the excess portion being selectively separable from the application portion, and a backing layer comprising a facing surface and an outer surface, wherein the stencil layer is at least initially and at least partially disposed between the transfer layer and the backing layer such that the bottom surface of the stencil layer is engaged with the first surface of the transfer layer, removing the backing layer from the stencil layer to expose the top surface of the stencil layer which is devoid of and configured to receive a cosmetic product, after removing the backing layer from the stencil layer, applying the cosmetic product to the application portion of the stencil layer and to at least a portion of the excess portion, after applying the product to the application portion of the stencil layer, removing the excess portion of the stencil layer along the demarcation line, leaving the application portion of the stencil layer attached to the transfer layer, using the transfer layer, temporarily applying the application portion of the stencil layer to the surface of the user's skin, wherein the product disposed on the application portion of the stencil layer is facing the surface of the user's skin, and removing the transfer layer and the application portion of the stencil layer from the surface of the user's skin to reveal a transfer of at least a portion of the product from the application portion of the stencil layer to the surface of the user's skin.

15. The method as recited in claim 14 further comprising defining the transfer layer and the backing layer as both comprising a length greater than a length of the stencil layer, wherein the backing layer comprises a tab defined as a portion of the backing layer extending at least partially beyond the length of the stencil layer.

16. The method as recited in claim 14 further comprising defining the transfer layer as being at least partially transparent.

17. The method as recited in claim 14 further comprising defining the application portion as comprising a wing-shaped configuration defined by at least two elongated edges converging at an apex.

18. A method of applying a product to a surface of a user's skin, the method comprising:

providing a cosmetic stencil assembly, the cosmetic stencil assembly comprising:

a transfer layer comprising a first surface and a second surface, and a flexible stencil layer comprising a top surface and a bottom surface, the stencil layer further comprising an application portion defining a shape of product to be transferred to a user, the shape defined by a demarcation line, and an excess portion extending outward from the demarcation line such that it forms at least a partial outer perimeter of the stencil layer, the excess portion being selectively separable from the application portion, and wherein the stencil layer is at least initially and at least partially layered on top of the transfer layer such that the bottom surface of the stencil layer is engaged with the first surface of the transfer layer, applying the product to the application portion of the stencil layer, removing the excess portion of the stencil layer from the transfer layer along the demarcation line, leaving the application portion of the stencil layer attached to the transfer layer, wherein the application portion of the stencil layer comprises the product applied thereto, using the transfer layer, temporarily applying the application portion of the stencil layer to the surface of the user's skin, wherein the product disposed on the application portion of the stencil layer is facing the surface of the user's skin, and removing the transfer layer and the application portion of the stencil layer from the surface of the user's skin to reveal a transfer of at least a portion of the product from the application portion of the stencil layer to the surface of the user's skin.

19. The method as recited in claim 18 further comprising:

defining the cosmetic stencil assembly as comprising a backing layer comprising a facing surface and an outer surface, the stencil layer being disposed at least initially between the transfer layer and the backing layer, and removing the backing layer from the stencil layer to expose the top surface of the stencil layer which is devoid of and configured to receive the product.

* * * * *